US008572871B2

(12) United States Patent
Voitchovsky

(10) Patent No.: US 8,572,871 B2
(45) Date of Patent: Nov. 5, 2013

(54) IRONING SYSTEM

(75) Inventor: Serge Voitchovsky, Mézières (CH)

(73) Assignee: Laurastar S.A., Châtel-St-Denis (CH)

( * ) Notice: Subject to any disclaimer, the term of this patent is extended or adjusted under 35 U.S.C. 154(b) by 189 days.

(21) Appl. No.: 13/119,104

(22) PCT Filed: Sep. 17, 2009

(86) PCT No.: PCT/IB2009/054068
§ 371 (c)(1),
(2), (4) Date: Apr. 14, 2011

(87) PCT Pub. No.: WO2010/032204
PCT Pub. Date: Mar. 25, 2010

(65) Prior Publication Data

US 2011/0185604 A1 Aug. 4, 2011

(30) Foreign Application Priority Data

Sep. 18, 2008 (EP) ..... 08164620

(51) Int. Cl.
*D06F 75/38* (2006.01)
*D06F 75/20* (2006.01)

(52) U.S. Cl.
USPC ..... 38/93; 38/77.83

(58) Field of Classification Search
USPC ..... 38/77.83, 93, 88, 80, 81, 97
See application file for complete search history.

(56) References Cited

U.S. PATENT DOCUMENTS

| | | | | |
|---|---|---|---|---|
| 1,789,869 | A * | 1/1931 | Herrmann | 69/20 |
| 2,065,366 | A * | 12/1936 | Eichorn | 38/93 |
| 2,350,452 | A | 6/1944 | Envall | |
| 2,792,652 | A | 5/1957 | Dawson | |
| 2,792,977 | A * | 5/1957 | Klein | 223/36 |
| 2,970,394 | A * | 2/1961 | Brumbaugh | 38/77.9 |
| 3,045,371 | A | 7/1962 | Kurlinski | |
| 3,577,859 | A * | 5/1971 | Davidson | 38/71 |
| 7,516,566 | B2 * | 4/2009 | Yu | 38/77.83 |
| 8,037,627 | B2 * | 10/2011 | Pan et al. | 38/77.83 |
| 2010/0132230 | A1 * | 6/2010 | Pan | 38/93 |

FOREIGN PATENT DOCUMENTS

| | | |
|---|---|---|
| WO | 2006/134323 | 12/2006 |
| WO | 2008/081352 | 7/2008 |

OTHER PUBLICATIONS

English Translation of International Preliminary Report on Patentability (IPRP) for PCT/IB2009/054068, dated Apr. 5, 2011.
International Search Report for PCT/IB2009/054068, mailed Jan. 26, 2010.
Written Opinion of the International Searching Authority for PCT/IB2009/054068, mailed Jan. 26, 2010.

* cited by examiner

*Primary Examiner* — Ismael Izaguirre
(74) *Attorney, Agent, or Firm* — Nixon & Vanderhye P.C.

(57) ABSTRACT

The invention relates to an ironing iron including a sole plate (1), wherein at least one V-shaped recess (6) is placed, said recess (6) being particularly defined by a removable insert (2) forming a contour relative to the plane of the sole plate (1) and comprising at least one steam outlet (3), the recess further communicating with at least one steam inlet (7).

8 Claims, 3 Drawing Sheets

IRONING SYSTEM

This application is the U.S. national phase of International Application No. PCT/IB2009/054068, filed Sep. 17, 2009, which designated the U.S. and claims priority to European Application No, 08164620.0, filed Sep. 18, 2008, the entire contents of each of which are hereby incorporated by reference.

FIELD OF THE INVENTION

The invention lies in the field of ironing and more precisely that of irons.

PRIOR ART

One iron that is known in the prior art is described for example in PCT application WO 02/090641. In this publication, the sole plate of the iron comprises a vaporizing chamber connected to outlet orifices through which the steam is injected into the fabric to be ironed in order to improve ironing.

Also known are iron sole plates that have bosses that are in contact with the fabrics in order to stretch the latter to a greater extent when the iron passes over and steam is released into said fabric. In this regard, see for example application WO 2008/081352 of the applicant.

SUMMARY OF THE INVENTION

The present invention constitutes an improvement with respect to prior art irons. It affords in particular optimized application of the steam to the fabrics, while promoting the relaxing of residual internal tensions in the fabrics following washing and drying.

To this end, the present invention consists of an iron comprising a sole plate in which there is arranged at least one "V"-shaped cavity, said cavity being delimited in particular by a removable insert forming a relief with respect to the plane of the sole plate and having at least one steam outlet orifice, the cavity communicating furthermore with at least one steam inlet orifice.

The effect of the presence of the "V"-shaped cavity is to create a buffer space for the steam, the latter being distributed in a more adequate manner over the fabric.

According to a first embodiment of the invention, the outlet orifice is a slot.

Alternatively, this orifice may have a circular section.

It is also possible to have a plurality of outlet orifices having identical or different sections.

The inlet orifice is advantageously in the form of an injection nozzle.

Preferably, the insert is secured to the sole plate by a clip-type mechanism.

According to another variant, the iron comprises a heating element located close to the outlet orifice or orifices, thereby ensuring good quality of the steam.

The invention furthermore relates to an ironing system comprising an iron as described above, said iron being connected fluidically and electrically to a steam generator comprising at least one water reservoir, at least one boiler, at least one thermal control means and at least one energy source so as to produce steam within said boiler and supply the iron with steam and/or thermal power.

DETAILED DESCRIPTION OF THE INVENTION

The invention is described in more detail hereinbelow by means of examples illustrated in the figures.

Figure 1:
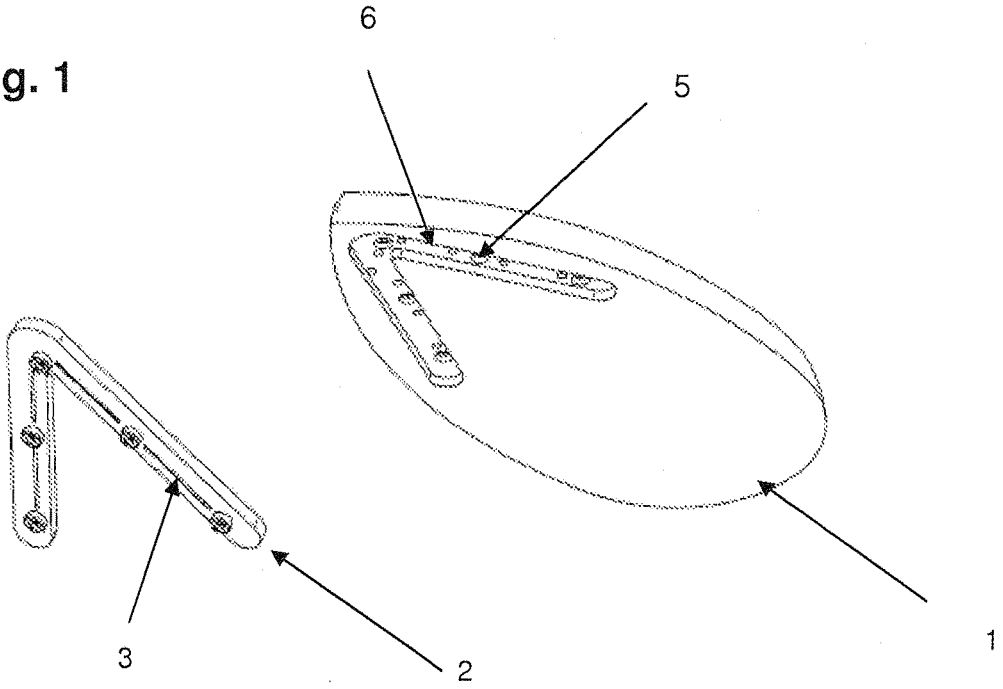
FIG. 1 shows a bottom view of the sole plate 1 of an iron.
Figure 2:
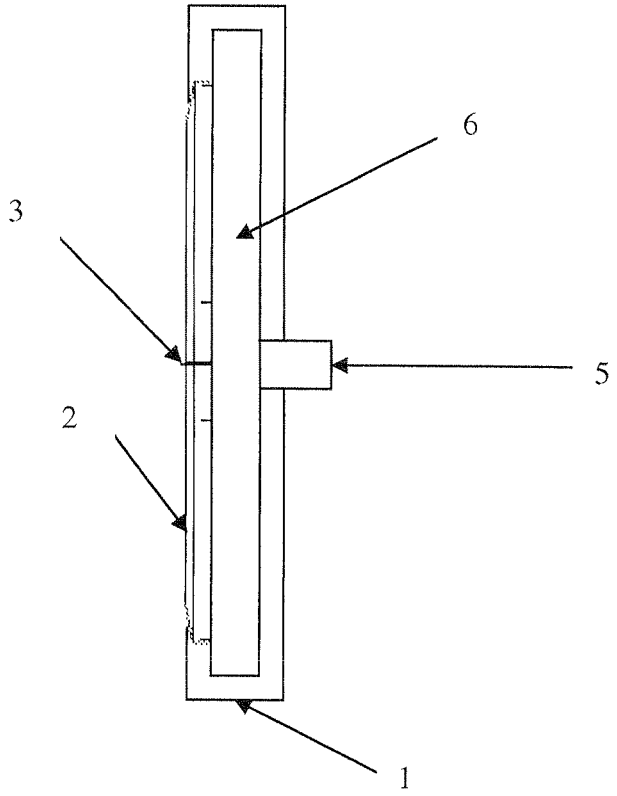
FIG. 2 shows a cross section through the iron and its sole plate.
Figure 3:
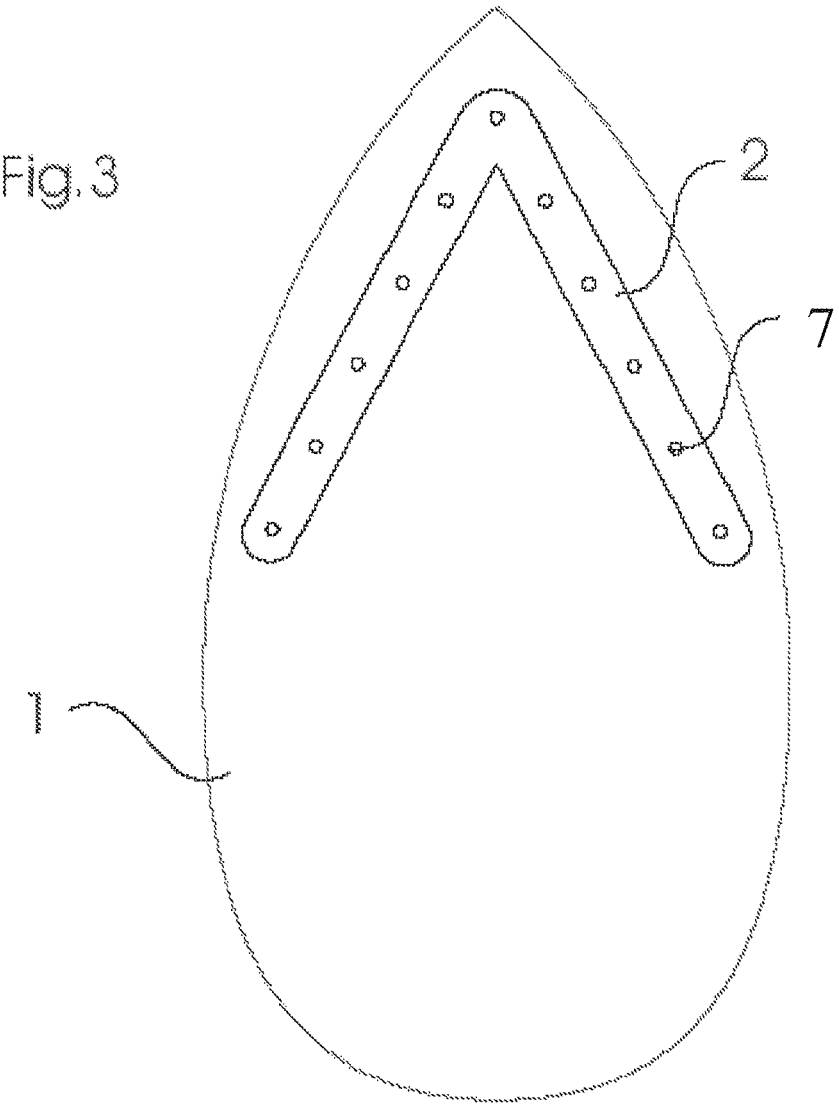
FIG. 3 shows a top view of an iron according to the invention.

The sole plate 1 has a "V"-shaped cavity 6 and an insert 2 in the form of a boss which is designed to cover the cavity 6.

The cavity has steam inlet orifices 5 in the form of circular holes.

The insert has steam outlet orifices 3 in the form of slots.

The effect of "V" the shape of the cavity is to distribute the steam in a homogeneous manner over the fabric. The tip of the "V" is located toward the front of the iron.

The removable insert 2 enables particularly easy maintenance (cleaning, replacement if necessary) of said sole plate and said insert.

When the iron is moved over the fabric in order to iron it, the boss presses the fabric into the soft cover of the ironing board and relaxes the residual tensions in the fabric.

Thus, after ironing, the relaxed fabric is perfectly smooth.

It goes without saying that the invention is not limited to the abovementioned examples.

The invention claimed is:

1. An iron comprising a sole plate, wherein there is arranged at least one "V"-shaped cavity in the sole plate, said cavity being delimited by a removable insert forming a relief within a plane of the sole plate and having at least one steam outlet orifice, and the cavity communicating furthermore with at least one steam inlet orifice.

2. The iron as claimed in claim 1, wherein said outlet orifice is a slot.

3. The iron as claimed in claim 1, wherein said outlet orifice is a circular hole.

4. The iron as claimed in claim 1, comprising a plurality of outlet orifices.

5. The iron as claimed in claim 1, wherein said inlet orifice is an injection nozzle.

6. The iron as claimed in claim 1, wherein said insert is secured to the sole plate by a clip-type mechanism.

7. The iron as claimed in claim 1, having a heating element located close to said outlet orifice or orifices.

8. An ironing system comprising an iron as claimed in claim 1, said iron being connected fluidically and electrically to a steam generator comprising at least one water reservoir, at least one boiler, at least one thermal control means and at least one energy source so as to produce steam within said boiler and supply the iron with steam and/or thermal power.

* * * * *